US007914607B2

(12) United States Patent
Moschütz et al.

(10) Patent No.: US 7,914,607 B2
(45) Date of Patent: Mar. 29, 2011

(54) DOMESTIC APPLIANCE COMPRISING AN ADSORPTION UNIT AND METHOD FOR OPERATING A DOMESTIC APPLIANCE OF THIS TYPE

(75) Inventors: Harald Moschütz, Groβbeeren (DE); Andreas Stolze, Falkensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 264 days.

(21) Appl. No.: 12/087,169

(22) PCT Filed: Dec. 12, 2006

(86) PCT No.: PCT/EP2006/069586

§ 371 (c)(1),
(2), (4) Date: Sep. 26, 2008

(87) PCT Pub. No.: WO2007/074052

PCT Pub. Date: Jul. 5, 2007

(65) Prior Publication Data

US 2009/0025557 A1 Jan. 29, 2009

(30) Foreign Application Priority Data

Dec. 29, 2005 (DE) ..... 10 2005 062 942

(51) Int. Cl.
*A47L 15/48* (2006.01)
*D06F 25/00* (2006.01)

(52) U.S. Cl. ..... 95/126; 95/146; 34/80; 34/86; 34/443; 62/324.3

(58) Field of Classification Search ..... 95/114, 95/115, 117, 121, 126, 148; 96/146; 34/443, 34/80, 86; 62/606, 324.1–324.3, 271
See application file for complete search history.

(56) References Cited

U.S. PATENT DOCUMENTS 4,817,296 A * 4/1989 Kabakov et al. ..... 34/77
(Continued)

FOREIGN PATENT DOCUMENTS

DE 1 410 206 10/1968
(Continued)

OTHER PUBLICATIONS

International Search Report for PCT/EP2006/069586, mailed Sep. 6, 2007.*

*Primary Examiner* — Frank M Lawrence
(74) *Attorney, Agent, or Firm* — James E. Howard; Andre Pallapies

(57) ABSTRACT

A domestic appliance including an adsorption unit and further including a process air conduit, wherein an adsorption container operates as a heat exchanger for heating a stream of air flowing in the process air conduit and being applied to the adsorption container, with the adsorption unit configured for alternate and reversible operation in a first operating state in which a stream of air flowing in the process air conduit is applied to the adsorption container and which adsorbs adsorptive evaporating in the phase transition container, and in a second operating state in which the adsorbing agent is heated by the heater and the adsorptive is desorbed, with desorbed adsorptive condensing in the phase transition container, the domestic appliance including an assembly operatively associated with the adsorption unit for applying a stream of air flowing in the process air conduit to the adsorption container in the second operating state.

16 Claims, 2 Drawing Sheets

U.S. PATENT DOCUMENTS

Figure 1:
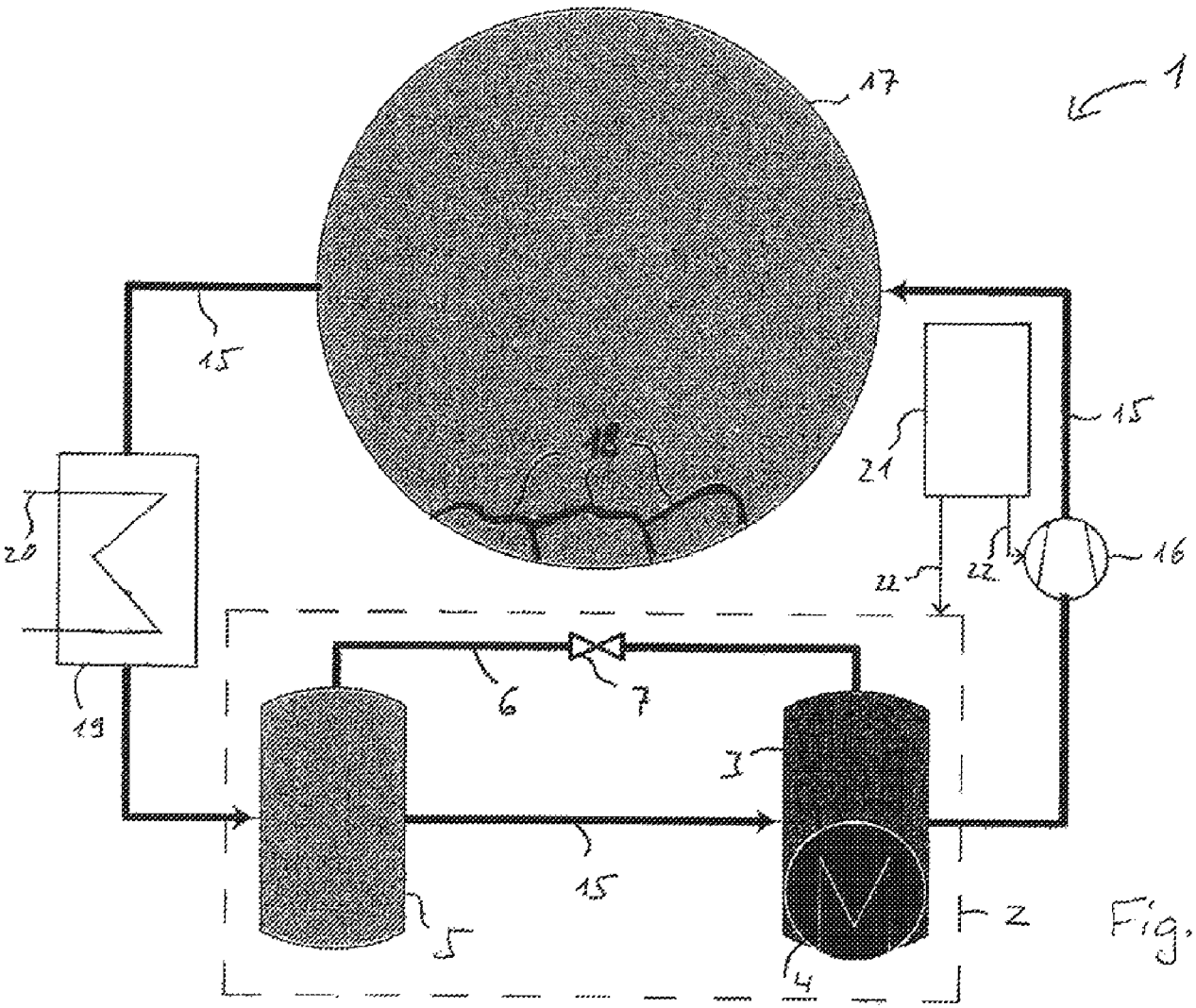

| | | | | |
|---|---|---|---|---|
| 6,434,857 | B1 * | 8/2002 | Anderson et al. | 34/595 |
| 7,017,282 | B2 * | 3/2006 | Pyo et al. | 34/596 |
| 2007/0157954 | A1 | 7/2007 | Classen et al. | |
| 2007/0234588 | A1 | 10/2007 | Classen et al. | |

FOREIGN PATENT DOCUMENTS

| | | | |
|---|---|---|---|
| DE | 10 2005 062 943 | | 7/2007 |
| EP | 0 777 998 | A1 | 6/1997 |
| WO | WO 2005/053504 | | 6/2005 |

* cited by examiner

DOMESTIC APPLIANCE COMPRISING AN ADSORPTION UNIT AND METHOD FOR OPERATING A DOMESTIC APPLIANCE OF THIS TYPE

The invention relates to a domestic appliance comprising an adsorption unit, with an adsorption container that holds a solid adsorbing agent and a heater for heating the adsorbing agent, at least one phase transition container with a connection line that connects the latter to the adsorption container and a volatile adsorptive that can be reversibly adsorbed by the adsorbing agent, and comprising a process air conduit, in which the adsorption container is embodied as a heat exchanger for heating an air stream that flows in the process air conduit and that is supplied to the adsorption container; in this appliance the adsorption unit is configured to alternately and reversibly assume a first operating state, in which the adsorption container is supplied with a stream of process air flowing in the process air conduit and adsorbs the adsorptive that is evaporating in the at least one phase transition container, and a second operating state in which the adsorbing agent is heated by a heater and desorbs the adsorptive, with desorbed adsorptive condensing in the phase transition container.

The invention also relates to a method for operation of such a domestic appliance.

EP 0 777 998 B1 discloses a domestic appliance in the form of a tumble dryer equipped with such an adsorption unit as well as a method for its operation. The adsorption unit is designed to support a drying process with the aim of saving energy.

A domestic appliance of this type is also disclosed in WO 2005/053502 A1. This domestic appliance is embodied as a dishwasher with a device for drying wet dishes, with said appliance featuring a heat pump equipped with an adsorption unit. The adsorbing agent, especially a zeolith, is contained in a first container embodied as a heat exchanger. The adsorptive, especially water, can circulate between the first container and a second container likewise embodied as a heat exchanger as well as in a connecting line between the containers.

A first operating state of the adsorption unit in accordance with WO 2005/053502 A1 consists of the adsorbing agent adsorbing the adsorptive evaporating from the second container; in this case the adsorbing agent heats up in the first container and the adsorptive cools down in the second container. Moist air which is drawn off into a circuit from a handling chamber with wet dishes, cools as it flows past the second container, and moisture contained in it cools and is removed from the air stream. This then reaches the first container, where it is heated up again and is returned to the handling chamber as a dry, hot air stream. This process dries the dishes.

A second operating state of this adsorption unit then consists of the adsorbing agent laden with the adsorptive being heated up with a heater. This drives the adsorptive out of the adsorbing agent and it arrives via the connecting line in the second container, where it condenses. This is assisted by the second container being cooled by a steam of air circulating in the circuit as just described. The air stream heated up in this way is used to preheat the dishes and or rinsing water present in the handling chamber.

A washing machine is disclosed in DE 1 410 206 A in which laundry can be not only washed but also dried. The document describes a number of alternatives for the additional devices required; in particular an electrical heater for heating up a stream of air used for drying laundry and a simple heat exchanger for cooling down the heated air stream after it has been applied to the laundry can be provided. The heater and the cooler can however also belong to a water pump device.

A document was made available on the Internet on 9 Dec. 2005 at the address http://de.wikipedia.org/wiki/Zeolith in which the materials pertaining to the generic term "Zeolith" are described. These materials involve aluminum silicate materials of complex composition, some of which are naturally available and some of which can be produced artificially, and which are especially capable of retaining large amounts of water. The disclosures of this document are to be fully ascribed to the present application.

A domestic appliance with an adsorption unit of the type described above can be operated such that, in an operating period in which a batch of laundry or of dishes in being dried, the adsorption device assumes the first and the second operating state only once; it can also be determined that the adsorption unit assumes the first and the second operating state in a reversible manner a number of times. In such a case it is a matter of whether the adsorption unit can be switched sufficiently quickly and easily from a given state into another operating state. It is in no way practical for such a change to lead to a significant delay in the operation of the domestic appliance.

The object of the invention is to specify a domestic appliance comprising an adsorption unit as well as a method for operating such a domestic appliance in which a rapid and uncomplicated switch between different operating states is possible.

The object is achieved by a domestic appliance comprising an adsorption unit which contains an adsorption container containing a solid adsorbing agent as well as a heater for heating up the adsorbing agent, at least one phase transition container with a connecting line connecting this to the adsorption container and a volatile adsorptive able to be reversibly adsorbed by the adsorbing agent, and comprising a process air conduit, in which the adsorption container is embodied as a heat exchanger for heating up a stream of air flowing in the process air conduit being applied to the adsorption container, with the adsorption unit being configured for alternate and reversible assumption of a first operating state in which a stream of air flowing in the process air conduit is applied to the adsorption container wherein the adsorbing agent adsorbs adsorptive evaporating in the at least one phase transition container, and of a second operating state in which the adsorbing agent is heated up by the heater and the adsorptive is desorbed, with desorbed adsorptive condensing in the phase transition container, characterized in that the adsorption unit is configured such that a stream of air flowing in the process air conduit is also applied to the adsorption container in the second operating state. The object is achieved by a method for operating a domestic appliance comprising an adsorption unit, which contains an adsorption container containing a solid adsorbing agent as well as a heater for heating up the adsorbing agent, at least one phase transition container with a connecting line connecting this to the adsorption container and a volatile adsorptive able to be reversibly adsorbed by the adsorbing agent, and comprising a process air conduit, in which the adsorption container is embodied as a heat exchanger for heating up a stream of air flowing in the process air conduit being applied to the adsorption container, with the adsorption unit being configured for alternate and reversible assumption of a first operating state in which a stream of air flowing in the process air conduit is applied to the adsorption container wherein the adsorbing agent adsorbs adsorptive evaporating in the at least one phase transition container, and of a second operating state in which the adsorbing agent is heated up by the heater and the adsorptive is desorbed, with desorbed adsorptive condensing in the phase transition container, characterized in that the adsorption unit is configured such that a stream of air flowing in the process air conduit is also applied to the adsorption container in the second operating state.

Accordingly the domestic appliance comprises an adsorption unit which features an adsorption container containing a solid adsorbing agent as well as a heater for heating up the adsorbing agent, at least one phase transition container with a connecting line connecting said container to the adsorption container and a volatile adsorptive able to be adsorbed reversibly by the adsorbing agent. To this end the domestic appliance includes a process air conduit, in which the adsorption container is embodied as a heat exchanger for heating up a stream of air flowing in the process air conduit and applied to the adsorption container. The adsorption unit is configured for alternate and reversible assumption of a first operating in state in which a stream of air flowing in the process air conduit is applied to the adsorption container and in which at least one adsorptive evaporating in a phase transition container is absorbed, and a second operating state in which the adsorbing agent is heated up by the heater and the adsorptive is desorbed, with desorbed adsorptive condensing in the phase transition container. In this case the absorption unit is inventively configured so that the absorption container also has a stream of air flowing in the process air conduit applied to it in a second operating state.

The method for operating a domestic appliance comprising an absorption unit containing a solid adsorption agent as well as a heater for heating up the absorption agent, at least one phase transition device with a connecting line connecting this to the adsorption container and a volatile adsorptive reversibly adsorbable by the absorption agent and comprising a process air conduit, in which the adsorption container is embodied as a first heat exchanger for heating up a stream of air flowing in the process air conduit and being applied to the absorption container, with the adsorption unit alternatively and reversibly assuming a first operating state in which a stream of air flowing in the process air conduit is applied to the adsorption container and the adsorptive evaporating in the at least one phase transition container and a second operating state in which the absorption agent is heated up by the heater and the adsorptive is desorbed. with desorbed adsorptive condensing in the phase transition container, is characterized in accordance with the invention by the adsorption container also having a stream of air flowing in the process air conduit applied to it in the second operating state.

The invention utilizes the fact that an application of the stream of air to the adsorption container which also continues in the second operating state cools components in the process air conduit and in the adsorption container which are not directly associated with the adsorption agent to be heated up and holds them at a temperature which is lower than any temperature which would be set without this application even if it restricts the effectiveness of the heating necessary to cause the desorption of the adsorptive from the absorption agent. This means however that the entry of heat into the adsorption container remains restricted to a degree necessary for heating the adsorption agent. Should the absorption container thus switch from the second operating state into the first operating state and if the adsorption agent is to be brought to a temperature which makes the adsorption process possible, this only requires the cooling down of the adsorption agent itself and of those components that are directly facing it. The thermal inertia of the adsorption unit is thus markedly reduced.

Preferably the at least one phase transition device is embodied in the domestic appliance as at least a second heat exchanger for cooling down a stream of air flowing in the process air conduit in the first operating state. This develops the use of the invention for a domestic appliance in which a steam of process air must be heated up and cooled down. Especially preferably in this case at least one process transition container is connected downstream from the adsorption unit in the process air conduit. This has the additional advantage that in the second operating state the air being applied to the phase transition container is heated up by the condensing adsorptive before it is applied to the adsorption container. The cooling effect of the process air on the adsorption container is usefully restricted and controlled by this.

An especially preferred domestic appliance is configured for handling articles with a stream of cooling air flowing in the process air conduit, with the adsorption unit functioning as a device for recovering heat within the stream of air, especially as a heat pump. This applies in particular to the first operating state, in which the phase transition container, as a result of the evaporating adsorptive, extracts heat from the air stream and the adsorption container, as a result of the exothermy of the adsorption process, emits heat to the stream of air. In such a process the adsorption unit reversibly assumes the first and the second operating state a number of times, for which it is especially suitable because of the inventively reduced thermal inertia of the adsorption container.

Especially preferably the domestic appliance is embodied as a dryer for the articles, especially as a tumble dryer.

In this case the air stream flowing in the process air conduit preferably removes moisture from the articles, and this discharged moisture is at least partly condensed out in the at least one phase transition container embodied as at least one second heat exchanger designed to cool down the stream of air.

Preferably the adsorption unit in the domestic appliance contains a single phase transition container, in which the adsorptive is able to be condensed and evaporated, as well as a connecting line connecting the adsorption container with the phase transition container. There do not have to be any moving parts present in this adsorption unit. State transitions can be brought about solely by heating up the adsorbing agent to drive out the adsorptive and by the adsorption process, which in the absence of the corresponding heating starts automatically.

An alternate preferred embodiment of the domestic appliance is characterized by the adsorption unit containing a number of phase transition containers, including a condensation container, in which the adsorptive is able to be condensed and which is connected to the adsorption container via a first line able to be closed off by a first valve and an evaporation container, in which the adsorptive is evaporated and which is connected to the adsorption container via a second line able to be closed off by a second valve, as well as a third line connecting the condensation container to the evaporation container. This embodiment does not have the advantage of managing if necessary without moving parts in the adsorption unit; however it allows corresponding components of the adsorption unit to be adapted more precisely to the required functions, especially of evaporating or condensing.

It is especially preferred for the domestic appliance to used a zeolith as its adsorbing agent and water as its adsorptive.

Also preferably the process air conduit is a single essentially closed circuit—able to be operated as a circuit without significant leakage of the stream of air but with a pressure equalization with surroundings of the process air conduit being provided at all times. In this embodiment the corresponding domestic appliance, if it were additionally configured for drying washing, would be referred to as a condenser dryer. In particular it is further preferred for the domestic appliance to feature an additional condenser through which the air stream is able to flow and preferably arranged on the upstream side of the adsorption unit.

Figure 2:
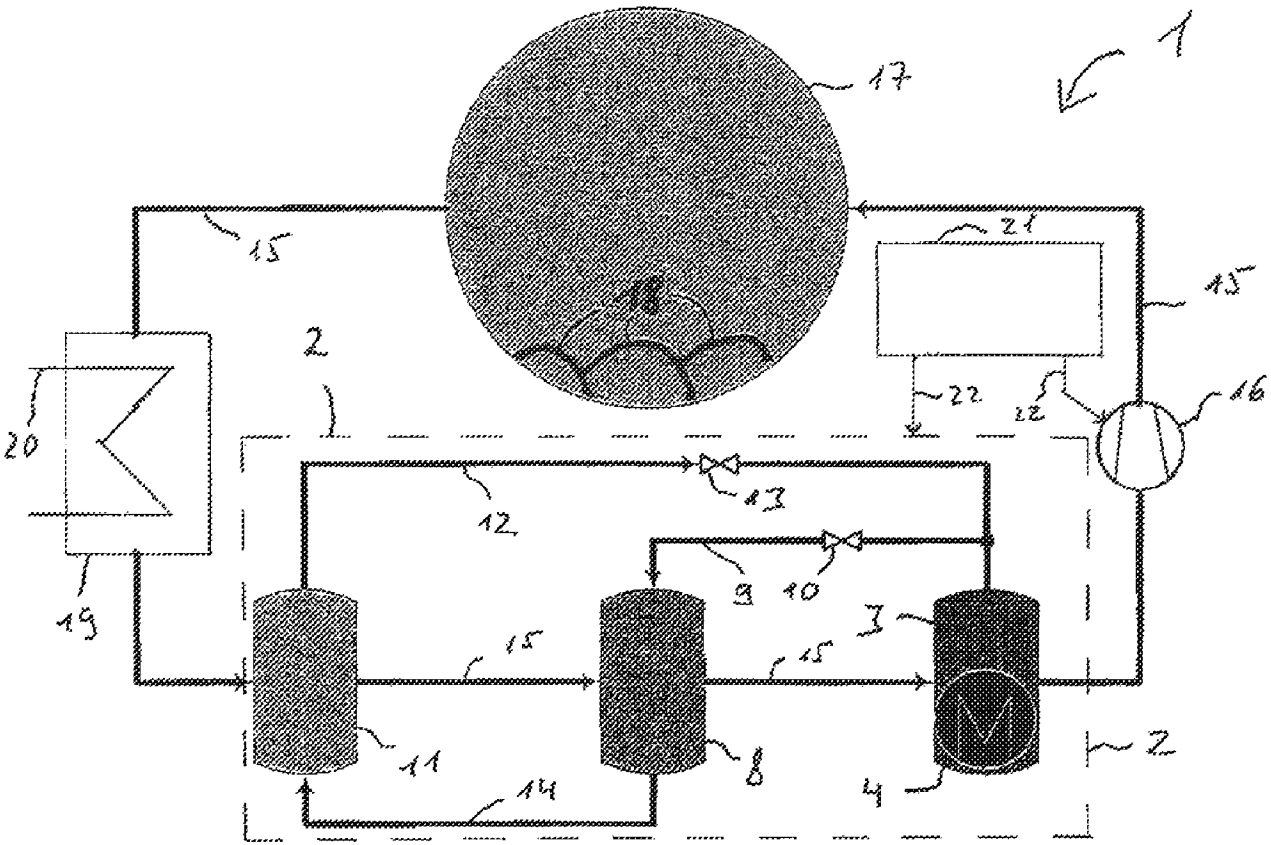

A preferred embodiment of the invention is described below with reference to the drawing, in which:

FIG. 1 and FIG. 2 show versions of a domestic appliance which is embodied as a tumble dryer with an adsorption unit in each case.

In the figures, each of which is to be seen as a schematic sketch, components which correspond to each other are labeled with the same reference symbol in each case.

FIG. 1 shows a domestic appliance 1, embodied as a tumble dryer 1, comprising an adsorption unit 2. The adsorption unit 2 includes an adsorption container 3*a* embodied as a first heat exchanger, which features a quantity of about 1 kg of a zeolith usable as an adsorbing agent. In addition the adsorption unit 2 contains a volatile adsorptive and one that can be adsorbed by the adsorption agent, predominantly water, in a quantity of around 1 kg. Apart from these the adsorption unit 2 is evacuated; air or air components are also present in traces, insofar as this is unavoidable in respect of use over many years and of all types of possible and sensible sealing measures in the adsorption unit 2. Depending on the operating state of the adsorption unit 2 the water is present in liquid or adsorbed form, as well as in its gaseous phase according to the temperature in the adsorption unit 2. The adsorption container 3 has a heater 4, through which it can be heated up, in order to drive off from the adsorbing agent water adsorbed by said agent. To receive the water in accordance with requirements, a single phase transition container 5 is provided embodied as a second heat exchanger which is connected via a single connecting line 6 to the adsorption container 3 and allows water to be transported between these two containers 3 and 5. This transport is controllable by means of a valve 7 inserted in the single connecting line 6—but this valve 7 is not required in every case since the adsorption unit 2 can also be controlled solely by the temperatures set in the containers 3 and 5.

FIG. 2 shows a tumble dryer 1 with an adsorption unit 2, with, instead of a single phase transition container 5 (cf. FIG. 1) a condensation container 8, connected to the adsorption container 3 via a first connecting line 9 with a first valve 10, and an evaporation container 11 connected to the adsorption container 3 via a second connecting line 12 with a first valve and additionally the condensation container 8 being connected to the evaporation container 11 via a third connecting line in the adsorption unit 2. A zeolith in a quantity of around 3 kg is provided as an adsorbing agent, and water in a quantity of around 1 kg as an adsorptive. The adsorption unit 2 is evacuated like the adsorption unit 2 of FIG. 1. In this adsorption unit 2 the adsorptive must follow a circuit between all three containers 3, 8 and 1, and this circuit is controlled with the valves 10 and 13.

To explain how the adsorption unit 2 is incorporated into the tumble dryer 1 reference is now made jointly to the two figures.

The tumble dryer 1 contains a process air conduit 15 for directing a stream of air 15 in a circuit 15, in which case it is driven by a fan 16. The air stream 15 arrives at a temperature of between 80° C. and 90° C. in the handling chamber 17, which is a rotatable drum 17 with articles 18 to be dried, namely laundry 18. In the drum 17 the air stream 15 extracts moisture from the washing 18, and is taken out of the drum 17 laden with such moisture. It then reaches a condenser 19, where heat is extracted from it, so that it cools down and condenses out the moisture that it has carried with it from the drum 17. Condensate thus produced is separated from the air stream 15 and discharged by a means not shown in the drawing. Beyond the condenser the air stream 15 arrives in the adsorption unit 2, where it flows through the containers 5 and 3 or, 8, 11 and 3 embodied as heat exchangers. In these containers, depending on the operating state of the adsorption unit 2, further heat is initially removed (first operating state) and then heat is applied or only heat is supplied (second operating state). In the corresponding heated-up state it then arrives via the fan 16 back in the drum 17.

If the tumble dryer 1 in accordance with FIG. 1 or FIG. 2 is in an idle state, the adsorptive is adsorbed as far as possible by the adsorbing agent. In this case the adsorption unit 2 is in a state characterized by especially high stability. If the tumble dryer 1 is switched from the idle state into the second operating state as described above, the drum 17 is rotated and the air stream 15 is established by the fan 16 and in addition the condenser 19, after a delay if necessary, is put into operation—for example by establishing an air stream 20. In the adsorption unit 2 the heater 4 in the adsorption container 3 is switched on and the adsorbing agent is heated up to a temperature of around 250° C. This initiates a desorption process in which the adsorptive is driven out of the adsorbing agent; it flows as steam from the phase transition container 5 or condensation container 8, controlled by the valve 7 or the valves 10 and 13. In the phase transition container 5 or condensation container 8 the steam gives off heat to the air stream 15 and condenses at a temperature in which the largely stationary state lies at around 70° C. The air stream 15 arrives after this first heating up at a temperature of around 65° C. at the adsorption container 3, where it takes up further heat and finally reaches the drum 17 at a temperature of around 90° C. There it takes up moisture and arrives at the condenser 19, where it is freed from this moisture and is cooled down to a temperature, which, on reaching the largely stationary state, lies at around 60° C.

To let the air stream 15 take up heat in the second operating state at the adsorption container 3 appears contradictory at first, since heat is withdrawn from the heater 4, which would otherwise be available for heating the zeolith in the adsorption container 3. However this is not a disadvantage since the air stream 15 would have to be heated up for maintaining the drying process in some other way instead, and since in this way part of the adsorption container 3 and the process air conduit 15 remains at relatively low temperature. This enables the adsorption agent to be cooled down rapidly after completion of the desorption to a temperature which allows the adsorption process, and especially a multiple or even manifold reversal between the first and the second operating state of the adsorption unit 2. In addition the heater 4 can be used here as the means for heating up the air stream.

The timing, temperature or pressure of the ending of the desorption process is controlled by switching off the heater 4, and on continuation of the drying of the washing 18 in the drum 17, the adsorption unit 2 reaches another operating state in accordance with the above nomenclature. In this case the adsorbing agent, as a result of the removal of heat from the adsorption container 3 by the air stream 15, cools off and, as the temperature drops, is prepared for new adsorption of the adsorptive. Since the adsorption executes exothermally, a heating effect is produced; the stream of air 15 flowing through the adsorption container 3 is heated up, with a temperature of 90° C. again being reached, in a largely stationary state.

In the tumble dryer in accordance with FIG. 1 the adsorptive can in principle return to the adsorbing agent without being controlled by the single valve 7, but a control intervention is necessary for any delay that may be desired. However, with the onset of adsorption the adsorptive collected in the phase transition container 5 in liquid form is vaporized at a temperature of around 50° C. while accepting the heat which is removed from the air stream 15 in the phase transition container 5. This means that further moisture condenses from the air stream 15 and it is thus cooled further. On reaching a largely stationary state the air stream 15 enters the container 5 at a temperature of around 60° C. and leaves it at a temperature of around 57° C. In this state the adsorption unit 2 operates as a heat pump and in this case can recover heat with a thermal pump power of up to 1200 W. The adsorption process ends if all adsorptive is bound to the adsorbing agent or the adsorbing agent has accepted a maximum possible quantity of the adsorptive. Then, brought about by a timer control or by an indication of a fall in temperature or of a drop in pressure in the adsorption container 3, a desorption process as described above is initiated once again.

In this way there can be multiple changes between adsorption and desorption for drying an item of washing 18, with the process of drying ending with an adsorption process however. Through this the adsorptive is bound as far as possible to the adsorbing agent for bringing the tumble dryer 1 to a halt, with the adsorption unit 2 being put into a state which is as useful as possible for an idle state of unspecific length by virtue of being as stable as possible.

The methods of operation of the tumble dryer 1 and of the adsorption unit 2 in accordance with FIG. 2 largely correspond to those described for FIG. 1. It is just that the adsorptive is condensed in a special condensation container 8, which is separated from an evaporation container 11, in the evaporation of the adsorptive occurs. The liquid adsorptive arrives at the evaporation container 11 from the condensation container 8 via the third connecting line 14. Condensation and evaporation of the adsorptive can occur at greatly differing temperatures—condensation at a temperature of up to 80° C. by heating up the stream of air from 57° C. to 70° C., evaporation at a temperature of around 20° C. by cooling down of the stream of air from 60° C. to 57° C.—and each of the containers 8 and 11 can be adapted to corresponding temperature conditions and—differences. It goes without saying that controlling interventions by means of the valves 10 and 13 are required to establish and maintain the circulation of the adsorptive.

In each exemplary embodiment the tumble dryer 1 and of the adsorption unit 2 are controlled by means of a control unit 21, which is connected to all controllable components 7 or, 10 and 13 as well as 16 and as required to any further component not shown (for example air stream 20 or sensors) via control lines 22. To aid clarity a single control line 22, which ends at the adsorption unit 2, is shown in the drawing; it is to be seen symbolic of any type of control line 22 for a component in the adsorption unit 2.

LIST OF REFERENCE SYMBOLS

1 Domestic appliance, tumble dryer
2 Adsorption unit
3 Adsorption container
4 Heater
5 Phase transition container
6 Single connecting line
7 Single valve
8 Condensation container
9 First connecting line
10 First valve
11 Evaporation container
12 Second connecting line
13 Second valve
14 Third connecting line
15 Process air conduit, air stream
16 Fan
17 Handling chamber, drum
18 Articles, washing
19 Condenser
20 Air stream
21 Control unit
22 Control line

The invention claimed is:

1. A domestic appliance including an adsorption unit, having an adsorption container containing a solid adsorbing agent; a heater for heating the adsorbing agent; at least one phase transition container in operational communication with the adsorption container by way of a connecting line; and a volatile adsorptive configured to be reversibly adsorbed by the adsorbing agent; the domestic appliance further including a process air conduit, wherein the adsorption container is operatively engaged as a heat exchanger for heating a stream of air flowing in the process air conduit and being applied to the adsorption container, with the adsorption unit being configured for alternate and reversible operation in a first operating state in which a stream of air flowing in the process air conduit is applied to the adsorption container wherein the adsorbing agent adsorbs adsorptive evaporating in the at least one phase transition container, and in a second operating state in which the adsorbing agent is heated by the heater and the adsorptive is desorbed, with desorbed adsorptive condensing in the phase transition container, the domestic appliance comprising:

means operatively associated with the adsorption unit for applying a stream of air flowing in the process air conduit to the adsorption container in the second operating state, wherein the adsorption unit reversibly assumes the first and the second operating state a plurality of times during one handling cycle of the domestic appliance in which articles handled by the domestic appliance are handled.

2. The domestic appliance according to claim 1, wherein the at least one phase transition container is operatively engaged as at least one second heat exchanger for cooling a stream of air flowing in the process air conduit in the first operating state.

3. The domestic appliance according to claim 1, further comprising means for handling the articles with a stream of air flowing in the process air conduit and wherein the adsorption unit is a device for recovering heat within the stream of air.

4. The domestic appliance according to claim 3, wherein the domestic appliance is a dryer for the articles and the dryer dries the articles during the handling cycle.

5. The domestic appliance according to claim 1, wherein the adsorption unit features a single phase transition container wherein the adsorptive is able to be condensed and evaporated, and wherein a single connecting line connects the adsorption container to the phase transition container.

6. The domestic appliance according to claim 1, wherein the adsorbing agent is a zeolith and the adsorptive is water.

7. The domestic appliance according to claim 1, wherein the process air conduit is formed as a closed circuit.

8. The domestic appliance according to claim 3, wherein the adsorption unit is a heat pump.

9. The domestic appliance according to claim 4, wherein the domestic appliance is a tumble dryer.

10. A domestic appliance including an adsorption unit, having an adsorption container containing a solid adsorbing agent; a heater for heating the adsorbing agent; at least one phase transition container in operational communication with the adsorption container using a connecting line; and a volatile adsorptive configured to be reversibly adsorbed by the adsorbing agent; the domestic appliance further including a process air conduit, wherein the adsorption container is operatively engaged as a heat exchanger for heating a stream of air flowing in the process air conduit and being applied to the adsorption container, with the adsorption unit being configured for alternate and reversible operation in a first operating state in which a stream of air flowing in the process air conduit is applied to the adsorption container wherein the adsorbing agent adsorbs adsorptive evaporating in the at least one phase transition container, and in a second operating state in which the adsorbing agent is heated by the heater and the adsorptive is desorbed, with desorbed adsorptive condensing in the phase transition container, the domestic appliance comprising:

means operatively associated with the adsorption unit for applying a stream of air flowing in the process air conduit to the adsorption container in the second operating state, wherein the adsorption unit includes a plurality of phase transition containers having a condensation container wherein the adsorptive is able to be condensed and which is connected to the adsorption container via a first connecting line configured to be closed with a first valve and an evaporation container wherein the adsorptive is evaporated, the evaporation container being connected to the adsorption container via a second connecting line configured to be closed with a second valve and a third connecting line connecting the condensation container to the evaporation container.

11. A domestic appliance including an adsorption unit, having an adsorption container containing a solid adsorbing agent; a heater for heating the adsorbing agent; at least one phase transition container in operational communication with the adsorption container using a connecting line; and a volatile adsorptive configured to be reversibly adsorbed by the adsorbing agent; the domestic appliance further including a process air conduit, wherein the adsorption container is operatively engaged as a heat exchanger for heating a stream of air flowing in the process air conduit and being applied to the adsorption container, with the adsorption unit being configured for alternate and reversible operation in a first operating state in which a stream of air flowing in the process air conduit is applied to the adsorption container wherein the adsorbing agent adsorbs adsorptive evaporating in the at least one phase transition container, and in a second operating state in which the adsorbing agent is heated by the heater and the adsorptive is desorbed, with desorbed adsorptive condensing in the phase transition container, the domestic appliance comprising:

means operatively associated with the adsorption unit for applying a stream of air flowing in the process air conduit to the adsorption container in the second operating state, wherein the process air conduit is formed as a closed circuit and features an additional condenser for condensing moisture out of the air stream.

12. The domestic appliance according to claim 11, wherein the additional condenser is disposed on the upstream side of the adsorption unit.

13. A method for operating a domestic appliance including an adsorption unit, having an adsorption container containing a solid adsorbing agent; a heater for heating the adsorbing agent; at least one phase transition container in operational communication with the adsorption container by way of a connecting line; and a volatile adsorptive configured to be reversibly adsorbed by the adsorbing agent; the domestic appliance further including a process air conduit, wherein the adsorption container is operatively engaged as a heat exchanger for heating a stream of air flowing in the process air conduit and being applied to the adsorption container, with the adsorption unit being configured for alternate and reversible operation in a first operating state in which a stream of air flowing in the process air conduit is applied to the adsorption container wherein the adsorbing agent adsorbs adsorptive evaporating in the at least one phase transition container, and in a second operating state in which the adsorbing agent is heated by the heater and the adsorptive is desorbed, with desorbed adsorptive condensing in the phase transition container, the domestic appliance comprising the step of:

applying a stream of air flowing in the process air conduit to the adsorption container in the second operating state, wherein the adsorption unit reversibly assumes the first and the second operating state a plurality of times during one handling cycle of the domestic appliance in which articles handled by the domestic appliance are handled.

14. The method according to claim and 13, further comprising the step of recovering heat using the adsorption unit in the second operating state, wherein the heat is recovered from within the stream of air flowing in the process air conduit.

15. The method according to claim 13, wherein the articles are dried in the handling cycle.

16. The method according to claim 15, further comprising the steps of removing moisture from the articles using the stream of air flowing in the process air conduit, and condensing out the removed moisture at least partly in the at least one phase transition container embodied as at least one second heat exchanger for cooling a stream of air flowing in the process air conduit.

* * * * *